US008245767B2

(12) United States Patent
Husges et al.

(10) Patent No.: US 8,245,767 B2
(45) Date of Patent: Aug. 21, 2012

(54) HEAT TRANSMISSION UNIT FOR AN INTERNAL COMBUSTION ENGINE

(75) Inventors: Hans-Jurgen Husges, Willich (DE); Hans-Ulrich Kuhnel, Monchengladbach (DE)

(73) Assignee: Pierburg GmbH, Neuss (DE)

( * ) Notice: Subject to any disclaimer, the term of this patent is extended or adjusted under 35 U.S.C. 154(b) by 739 days.

(21) Appl. No.: 12/202,727

(22) Filed: Sep. 2, 2008

(65) Prior Publication Data

US 2009/0056321 A1 Mar. 5, 2009

(30) Foreign Application Priority Data

Aug. 31, 2007 (DE) ..... 10 2007 041 338

(51) Int. Cl.
*F28F 13/00* (2006.01)

(52) U.S. Cl. ..... 165/146; 165/142; 165/157; 165/164

(58) Field of Classification Search ..... 165/141, 165/146, 151, 154, 155, 159, 160, 164, 142, 165/176
See application file for complete search history.

(56) References Cited

U.S. PATENT DOCUMENTS

| | | | | |
|---|---|---|---|---|
| 5,099,913 | A * | 3/1992 | Kadle | 165/147 |
| 6,206,089 | B1 * | 3/2001 | Uchikawa et al. | 165/109.1 |
| 6,241,011 | B1 * | 6/2001 | Nakamura et al. | 165/153 |
| 6,390,183 | B2 * | 5/2002 | Aoyagi et al. | 165/146 |
| 6,530,423 | B2 * | 3/2003 | Nakado et al. | 165/153 |
| 7,370,691 | B2 | 5/2008 | Klingler et al. | |
| 2005/0263276 | A1 | 12/2005 | Klingler et al. | |
| 2005/0269066 | A1 * | 12/2005 | Horiuchi et al. | 165/153 |
| 2007/0068663 | A1 | 3/2007 | Thomer et al. | |

FOREIGN PATENT DOCUMENTS

| | | | |
|---|---|---|---|
| DE | 20 2006 009 464 | U1 | 9/2006 |
| DE | 10 2005 058 204 | A1 | 6/2007 |

OTHER PUBLICATIONS

Office action issued in corresponding German application No. 10 2207 041 338.8, dated Mar. 3, 2008.

* cited by examiner

*Primary Examiner* — Ljiljana Ciric
*Assistant Examiner* — Indrajit Ghosh
(74) *Attorney, Agent, or Firm* — Griffin & Szipl, P.C.

(57) ABSTRACT

Heat transmission units are known wherein ribs for improving the cooling efficiency extend along the whole length of the flow path of the radiator. According to the invention, it is proposed, while keeping the constructional space at the same size, to provide a larger cooling surface in a first portion, which has a higher temperature gradient, and which is accomplished by a large number of ribs arranged therein, and to omit such ribs or to reduce their number in a region that has a lower temperature gradient, i.e. in a second portion. In this manner, the overall efficiency of such a heat transmission unit is improved.

10 Claims, 1 Drawing Sheet

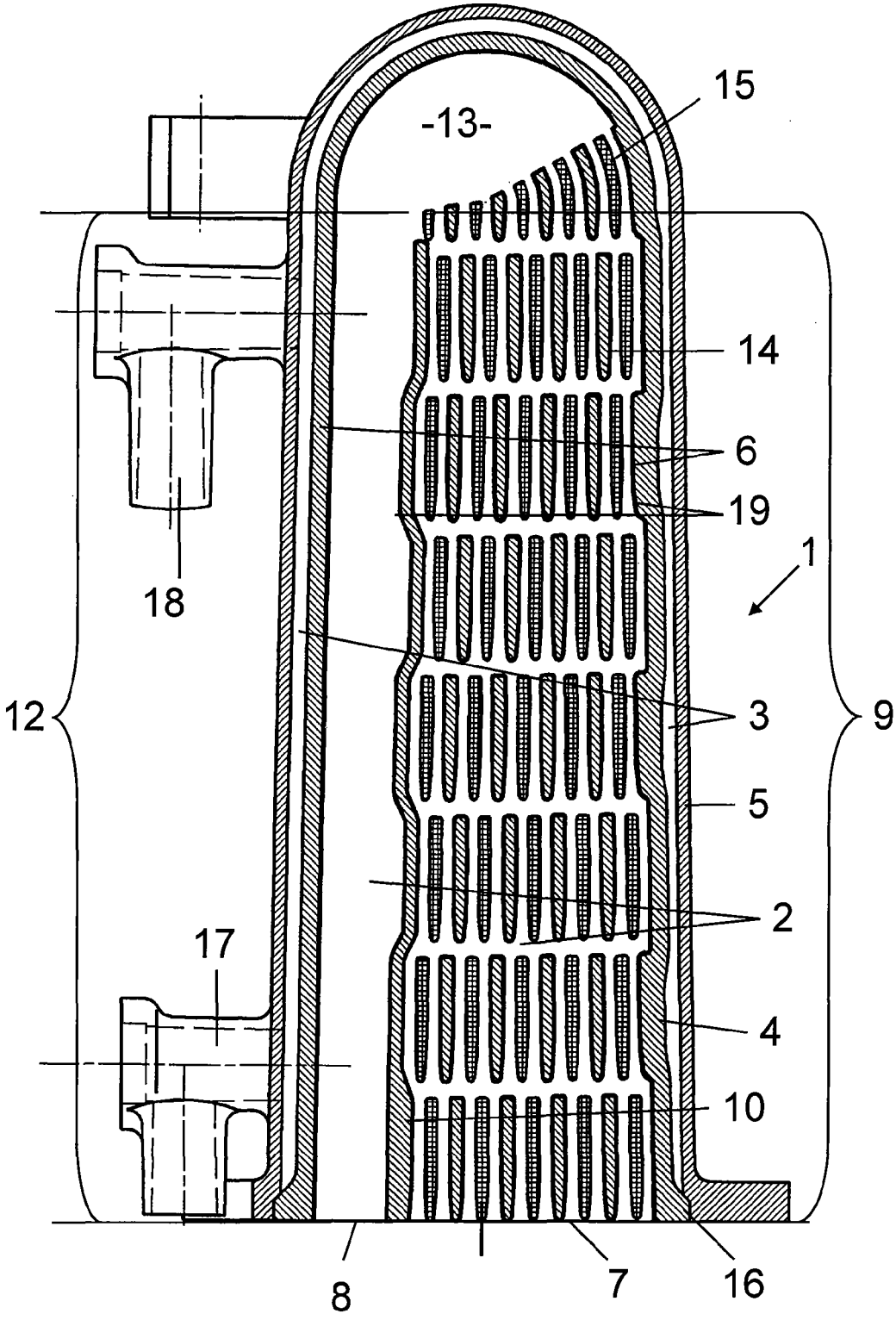
-13-
15
14
6
19
1
18
12
3
9
5
2
17
4
10
8
7
16

HEAT TRANSMISSION UNIT FOR AN INTERNAL COMBUSTION ENGINE

This application claims priority from German Patent Application No. 10 2007 041 338.8 filed Aug. 31, 2007, the entire disclosure of which is incorporated herein by reference.

FIELD OF THE INVENTION

The present invention relates to a heat transmission unit for use in an internal combustion engine, particularly for the cooling of exhaust gases, wherein the heat transmission unit comprises a channel conducting the fluid to be cooled and provided with an inlet and an outlet, and a channel conducting a cooling fluid and provided with an inlet and an outlet, wherein the channel for conducting the fluid to be cooled and the channel for conducting the cooling fluid are separated from each other by at least one partition wall, wherein the partition wall is provided with ribs extending from the partition wall into the channel conducting the fluid to be cooled.

BACKGROUND OF THE INVENTION

Heat transmission units for use in internal combustion engines are generally known and have been described in a large number of patent applications. Heat transmission units of this type serve both for the cooling of gases, such as e.g. charge air or exhaust gas, and for the cooling of liquids such as e.g. oil.

Not least due to their large variety of possible uses, heat transmission units are known in very diverse configurations. Examples in this regard are, particularly, tubular radiators, plate-type radiators and radiators of the die-cast type.

Especially in the cooling of exhaust gases, an excessive sooting of the channels for exhaust-gas throughflow should be prevented; as a result, the cross section of the channels should not be selected to be too small. In order to provide a reliable heat transition in spite of this restriction, radiators have been developed, particularly of the type produced by die casting, wherein the partition walls between a channel for cooling-fluid throughflow and a channel for throughflow of the fluid to be cooled are provided with ribs extending into the channel for the to-be-cooled fluid. Particularly in case of high temperature gradients, these ribs will considerably improve the heat transition.

A heat exchanger of the above type is known from DE 10 2005 058 204 A1, for instance. The heat exchanger disclosed therein comprises an inner shell and an outer shell, with the cooling fluid flowing between the outer shell and the inner shell while the fluid to be cooled will follow a U-shaped course through the inner shell, i.e. will first flow via the inlet into an inflow portion and from there, via a deflection region and a subsequent return flow portion, to the outlet. From the partition wall between the two channels, ribs extend into the fluid-conducting channel along the whole length of the channel.

Heat exchangers of the above configuration have been found to suffer from the disadvantage that the cooling effect will decrease along with a decreasing temperature gradient. Further, the deflection region of such a U-shaped heat transmission unit will accumulate distinctly more sooting, thus causing an increasing loss of pressure.

Thus, it is an object of the present invention to provide a heat transmission unit wherein, while the pressure loss remains the same or is even smaller, the cooling efficiency is improved in comparison with known configurations, while not requiring additional constructional space for this purpose.

SUMMARY OF THE INVENTION

To achieve the above object, it is provided according to the invention that a cross-sectional area between the walls delimiting the channel conveying the fluid to be cooled is larger in a first portion than in a second portion, the ribs being distributed along the length of the channel in such a manner that an effective flow-conducting cross section is smaller in the first fluid-conveying portion than the effective flow-conducting cross section in the second fluid-conveying portion, or is equal thereto. Thus, in comparison to known units, the number of ribs in the first portion, in which a high temperature gradient exists, can be considerably increased so that a distinctly higher cooling efficiency is obtained. The increased pressure loss occurring in this region as compared to known configurations, can be compensated for in the second portion, so that the dwelling time in comparison to known units of the same size can be remain substantially the same.

According to a further embodiment of the invention, the second portion of the channel conveying the fluid to be cooled is formed as a rib-free cross section. By this rib-free cross section in the second portion, the pressure loss due to the missing installations in the channel of the heat transmission unit can be reduced in comparison to known configurations, and the space requirement for the second portion can be minimized.

According to the invention, it is proposed, while keeping the constructional space at the same size, to provide a larger cooling surface in a first portion (9), which has a higher temperature gradient, and which is accomplished by a large number of ribs (14) arranged therein, and to omit such ribs or to reduce their number in a region that has a lower temperature gradient, i.e. in a second portion (12). In this manner, the overall efficiency of such a heat transmission unit is improved.

According to a preferred embodiment, the channel conveying the fluid to be cooled is U-shaped, the first portion is serving as an inflow portion that is followed by a deflection region, and the deflection region in turn is followed by the second portion serving as a return flow portion. In such a U-shaped configuration, the inflow portion and the return flow portion are arranged adjacent to each other. Thereby, the inflow portion, while having the same width on the whole, can be made wider and be provided with additional ribs, resulting in an improvement of the cooling efficiency in the range of high temperature gradients. At the same time, the pressure loss, when compared to the known configuration with ribs along the whole region, is kept constant or is even reduced, depending on the given case.

According to a still further embodiment, the deflection region is substantially formed as a rib-free cross section. Thus, as compared to known radiators with U-shaped flow path, sooting in the deflection region can be largely avoided. An increase of the pressure loss and a deterioration of the cooling efficiency can thus be prevented, and particularly so over the whole operating lifetime of the heat transmission unit, since the sooting in the deflection region will be considerably reduced.

By the above disclosed configurations, there is provided a heat transmission unit that is optimized with respect to cooling efficiency and constructional size without generating an increased loss of pressure.

In more detail, and in accordance with a first illustrative embodiment of the present invention, a heat transmission unit for use in an internal combustion engine, particularly for the cooling of exhaust gases, is provided, wherein the heat transmission unit includes: a channel (2) conducting the fluid to be cooled and provided with an inlet (7) and an outlet (8), and a channel (3) conducting a cooling fluid and provided with an inlet (17) and an outlet (18), wherein the channel (2) for conducting the fluid to be cooled and the channel (3) for conducting the cooling fluid are separated from each other by at least one partition wall (6) provided with ribs (14,15) extending from the partition wall (6) into the channel (2) conducting the fluid to be cooled, wherein a cross-sectional area between walls (6,10) delimiting the channel (2) conveying the fluid to be cooled, is larger in a first portion (9) than in a second portion (12), and the ribs (14) are distributed along the length of the channel (2) in such a manner that an effective flow-conducting cross section is smaller in the first fluid-conveying portion (9) than the effective flow-conducting cross section in the second fluid-conveying portion (12), or is equal thereto. In accordance with a second illustrative embodiment of the invention, the first illustrative embodiment is modified so that the second portion (12) of the channel (2) conveying the fluid to be cooled is formed as a free cross section (i.e., a rib-free cross section). In accordance with a third illustrative embodiment of the invention, the first illustrative embodiment is modified so that the channel (2) conveying the fluid to be cooled is U-shaped, the first portion (9) serving as an inflow portion that is followed by a deflection region (13), and the deflection region (13) is followed by the second portion (12) serving as a return flow portion. In accordance with a fourth illustrative embodiment of the present invention, the third illustrative embodiment is further modified so that the deflection region (13) is substantially formed as a free cross section (i.e., a rib-free cross section).

An embodiment of the heat transmission unit of the invention is schematically illustrated in the FIGURE and will be explained in greater detail as follows.

BRIEF DESCRIPTION OF THE DRAWING

The sole FIGURE of the drawing is a sectional view of a heat transmission unit according to the invention.

DETAILED DESCRIPTION OF A PREFERRED EMBODIMENT

The heat transmission unit illustrated in the FIGURE, to be used particularly for the cooling of exhaust gases of an internal combustion engine, comprises a housing 1 including a channel 2 provided to conduct a fluid to be cooled, and a channel 3 providing to conduct a cooling fluid. Housing 1 consists of a one- or multi-part inner shell 4 and an outer shell 5 surrounding inner shell 4 and being generally spaced from inner shell 4.

In the present embodiment, the channel 3 conducting the cooling fluid is arranged between inner shell 4 and outer shell 5 while the channel 2 conducting the fluid to be cooled is delimited by inner shell 4. Thus, inner shell 4 forms a partition wall 6 between the two fluids undergoing mutual heat exchange.

Inner shell 4, like outer shell 5, is open on one of its sides, and on its open end side is provided with a first inlet 7 and a first outlet 8 adjacent thereto. The inlet 7 is followed by a first portion 9 that serves as an inflow portion and is separated by a central wall 10 from a second portion 12, the second portion 12 serving as a return flow portion and in turn entering the outlet 8. In flow direction between the inflow portion 9 and the return flow portion 12, the flow passes through a deflection region 13, with central wall 10 ending at the start of the deflection region 13.

Arranged in inflow portion 9 are a plurality of ribs 14 projecting from the inner shell 4 and thus from the partition wall 6 into the channel 2 conducting the fluid to be cooled. In deflection region 13, inner shell 4 is merely in the region of the first portion still provided with partial ribs 15 whereas the rest of deflection region 13 is left without further ribs. The absence of ribs 14 in deflection region 13 offers the advantage of keeping this region largely free of sooting which otherwise is frequently observed in this region. The ribs 14 are also continued in the form of protrusions 19 formed on the central wall 10 and respectively on the partition walls 6 so that, also in an arrangement where the ribs 14 are positioned in rows behind each other in a staggered configuration, the cross sections for the flow passage can be largely kept constant in the region of a row of ribs without the necessity to change the rib shape.

In the present embodiment, no ribs are formed in the return flow portion 12 so that the latter represents a free cross section (i.e., a rib-free cross section). By way of alternative, individual ribs can be provided also there. The existing cross section without ribs between the partition walls 6 and the central wall 10 is much larger in the inflow portion than in the return flow portion. The arrangement and respectively distribution of the ribs 14 is selected such that the effective flow-conducting cross section in the inflow portion 9 is reduced by means of a large number of ribs 14 to such an extent that, in comparison to return flow portion 12, the cross section—in spite of its larger width caused by the absence of ribs—is smaller than or identical with the effective flow-conducting cross section of the return flow portion 12. The widening of the effective flow-conducting cross section is provided in deflection region 13.

A configuration of the above type is selected since, in the region of inflow portion 9, the temperature gradient between the entering hot fluid, particularly exhaust gas, and the cooling fluid flowing therearound is particularly large. Therefore, in this region, by the effect of the additional ribs provided in comparison to known configurations, which require the same constructional space, the available cooling surface across the cross section as well as the dwelling time in this region will be increased. Even though this does cause an increase of the flow resistance and thus of the pressure loss, such developments will be compensated for by the larger effective flow-conducting cross section in the second portion. In the above arrangement, although less cooling efficiency is generated in the rear regions where the temperature gradient is low, this is more than compensated for by the cooling efficiency obtained in the first portion. Thus, on the whole, in comparison to known configurations with uniform cross sections and rib distribution, the cooling efficiency along the total flow path, with about the same dwelling time and the same constructional space, will be increased.

On inlet 7 and respectively outlet 8, the inner shell 4 is additionally formed with a flange-shaped widened portion 16 on which the outer shell 5 can be attached to the inner shell 4, e.g. by welding. The flange-shaped widened portion 16 also serves as a closure for the channel 3 conducting the cooling fluid.

Outer shell 5 in turn is provided with an inlet 17 and an outlet 18, which in the present embodiment are arranged laterally on outer shell 5 in the front and rear regions of the heat transmission unit. Inner shell 4 can further be provided with webs, extending all the way to outer shell 5, for forced guidance of the cooling fluid.

It should be evident that this construction is applicable also for use in heat transmission units of different designs; in this regard, is should be observed that, with the available constructional space remaining the same, the used cooling surface should be enlarged in the region of high temperature gradients, even though this measure causes a reduction of the cooling surfaces in the region of smaller temperature gradients.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

The invention claimed is:

1. A heat transmission unit for use in an internal combustion engine to cool exhaust gases, wherein the heat transmission unit comprises:

(a) a first channel conducting a first fluid to be cooled and provided with a first inlet and a first outlet; and (b) a second channel conducting a cooling second fluid and provided with a second inlet and a second outlet, wherein the first channel for conducting the first fluid to be cooled and the second channel for conducting the cooling second fluid are separated from each other by at least one partition wall provided with a plurality of first ribs and second ribs extending from the at least one partition wall into the first channel conducting the first fluid to be cooled, wherein a cross-sectional area, between the at least one partition wall and a central wall delimiting the first channel conveying the first fluid to be cooled, is larger throughout a first fluid-conveying portion than in a second fluid-conveying portion, wherein the first ribs are distributed along a length of the first channel so that an effective flow-conducting first cross section is smaller in the first fluid-conveying portion than an effective flow-conducting second cross section in the second fluid-conveying portion, or is equal thereto.

2. The heat transmission unit according to claim 1, wherein said second fluid-conveying portion of the first channel conveying the first fluid to be cooled is formed as a rib-free cross section.

3. The heat transmission unit according to claim 1, wherein the first channel conveying the first fluid to be cooled is U-shaped, wherein the first fluid-conveying portion serves as an inflow portion that is followed by a deflection region, and the deflection region is followed by the second fluid-conveying portion that serves as a return flow portion.

4. The heat transmission unit according to claim 3, wherein said deflection region is substantially formed as a rib-free cross section.

5. The heat transmission unit according to claim 3, wherein the second ribs are partial ribs having a different geometry than the first ribs, and the second ribs are disposed between the first ribs and a rib-free portion of the deflection region.

6. The heat transmission unit according to claim 1, further comprising:

(c) an inner shell, wherein the inner shell comprises the at least one partition wall; and (d) an outer shell, wherein the outer shell surrounds the inner shell, and wherein the inner shell is provided with a flange-shaped widened portion on which the outer shell is attached.

7. The heat transmission unit according to claim 6, wherein the inner shell is provided with a plurality of webs extending all the way to the outer shell in the second channel in order to force guidance of the cooling second fluid.

8. The heat transmission unit according to claim 1, wherein the first fluid to be cooled is an exhaust gas, and the first fluid to be cooled and the cooling second fluid are arranged so as to undergo mutual heat exchange.

9. A heat transmission unit for use in an internal combustion engine to cool exhaust gases, wherein the heat transmission unit comprises:

(a) a first channel conducting a first fluid to be cooled and provided with a first inlet and a first outlet; and (b) a second channel conducting a cooling second fluid and provided with a second inlet and a second outlet, wherein the first channel for conducting the first fluid to be cooled and the second channel for conducting the cooling second fluid are separated from each other by at least one partition wall provided with a plurality of first ribs and second ribs extending from the at least one partition wall into the first channel conducting the first fluid to be cooled, wherein a cross-sectional area, between the at least one partition wall and a central wall delimiting the first channel conveying the first fluid to be cooled, is larger throughout a first fluid-conveying portion than in a second fluid-conveying portion, wherein the first ribs are distributed along a length of the first channel so that an effective flow-conducting first cross section is smaller in the first fluid-conveying portion than an effective flow-conducting second cross section in the second fluid-conveying portion, or is equal thereto, and wherein a temperature gradient of the first fluid-conveying portion is higher than a temperature gradient of the second fluid-conveying portion.

10. The heat transmission unit according to claim 9, further comprising:

(c) an inner shell, wherein the inner shell comprises the at least one partition wall; and (d) an outer shell, wherein the outer shell surrounds the inner shell, and wherein the inner shell is provided with a flange-shaped widened portion on which the outer shell is attached.

* * * * *